United States Patent [19]

Watanabe

[11] Patent Number: 4,702,631

[45] Date of Patent: Oct. 27, 1987

[54] THERMAL RIBBON CASSETTE AND HOUSING THEREFORE

[75] Inventor: Junji Watanabe, Yokohama, Japan

[73] Assignee: Kabushiki Kaisha Toshiba, Japan

[21] Appl. No.: 795,860

[22] Filed: Nov. 7, 1985

[30] Foreign Application Priority Data

| | | | |
|---|---|---|---|
| Nov. 8, 1984 | [JP] | Japan | 59-235646 |
| Nov. 14, 1984 | [JP] | Japan | 59-240210 |
| Nov. 14, 1984 | [JP] | Japan | 59-240220 |

[51] Int. Cl.[4] ..... B41J 35/28

[52] U.S. Cl. ..... 400/208; 400/224.2; 400/236.2; 400/649; 400/692; 346/76 PH; 242/68.3

[58] Field of Search ..... 400/120, 196.1, 203, 400/208, 225, 656, 660, 660.2, 692, 693.1, 224, 2, 235, 235.1, 236, 236.1, 236.2, 694.4, 691; 128/391, 419 PS; 346/76 R, 76 PH, 145; 354/173.1, 275; 362/208; 242/68.3

[56] References Cited

U.S. PATENT DOCUMENTS

| | | | |
|---|---|---|---|
| 1,433,181 | 10/1922 | Cossitt | 400/203 |
| 2,888,310 | 5/1959 | Perry | 346/145 |
| 4,053,040 | 10/1977 | Mcgourty | 400/124 |
| 4,134,695 | 1/1979 | Randolph | 400/320 |
| 4,311,401 | 1/1982 | Hiki et al. | 400/656 |
| 4,325,107 | 4/1982 | MacLead | 362/208 |
| 4,468,139 | 8/1984 | Hattori | 400/208 |
| 4,480,933 | 11/1984 | Shibayama et al. | 400/120 |
| 4,496,955 | 1/1985 | Maeyama | 400/120 |
| 4,589,787 | 5/1986 | Seki et al. | 400/145.2 |
| 4,611,937 | 9/1986 | Sato et al. | 400/208 |
| 4,620,199 | 10/1986 | Tatsumi et al. | 346/76 PH |

FOREIGN PATENT DOCUMENTS

| | | | |
|---|---|---|---|
| 84630 | 3/1983 | European Pat. Off. | 400/656 |
| 3035633 | 5/1982 | Fed. Rep. of Germany | 354/275 |
| 3136192 | 3/1983 | Fed. Rep. of Germany | 400/660 |
| 67278 | 6/1981 | Japan | 400/208 |
| 24478 | 2/1983 | Japan | 400/208 |
| 55281 | 4/1983 | Japan | 400/208 |
| 173687 | 10/1983 | Japan | 400/120 |
| 38083 | 3/1984 | Japan | 400/120 |
| 103776 | 6/1984 | Japan | 400/120 |
| 179390 | 10/1984 | Japan | 400/120 |

*Primary Examiner*—Edgar S. Burr
*Assistant Examiner*—David A. Wiecking
*Attorney, Agent, or Firm*—Finnegan, Henderson, Farabow, Garrett & Dunner

[57] ABSTRACT

An improved image building apparatus of the type including a platen roller and a recording head in which a recuired image is built on printing medium by transfering coloring agent on ink donor medium onto printing medium with the aid of the recording head which is activated in response to image information while ink donor medium and printing medium are interposed between the platen roller and the recording head. To construct the apparatus in smaller dimensions the platen roller is disposed in the area located between a pair of cores in the cassette in which ink donor medium is spanned therebetween. Arrangement is made such that the platen roller is displaced together with the cassette as the latter is fitted to or removed from the housing of the apparatus. The housing includes a pair of casette supporting members which are removably inserted into openings of the cores in the cassette. Each of cassette supporting members has a hollow space in which a plurality of dry batteries are accommodated as electric power source for the apparatus.

12 Claims, 23 Drawing Figures

THERMAL RIBBON CASSETTE AND HOUSING THEREFORE

BACKGROUND OF THE INVENTION

1. Field of the Invention

The present invention relates to an image building apparatus of the type including a platen roller and a recording head in which a required image is built on printing medium by transferring coloring agent on an ink donor medium and printing medium which are interposed between the recording head and the platen roller, and more particularly to improvement of or relating to an image building apparatus of the above-mentioned type which assures that the apparatus is constructed in smaller dimensions particularly in height.

2. Description of the Prior Art

As a typical conventional image building apparatus of the above-mentioned type a thermal transfer type printer is widely known. The conventional thermal transfer type printer is usually so constructed that the recording head is designed in the form of a thermal head and a strip of ink ribbon with thermaly fusible or sublimable ink coated thereon is used as ink donor medium.

In the thermal transfer type printer, the middle part of an ink ribbon of which both ends are wound about a pair of cores is interposed between the platen roller and the thermal head and paper is held between the ink ribbon and the platen roller. A required image is built on paper by transferring ink on the ink ribbon onto paper with the aid of the thermal head which comprises a number of heating elements adapted to be heated in response to image information while the above-mentioned positional state is maintained.

Some of the conventional thermal transfer type printers are so constructed that both ink ribbon and cores are accommodated in a case in the form of a ribbon cassette for the purpose of facilitating replacement of a used ink ribbon with a new one.

In the conventional printer of the above-mentioned type, the platen roller is disposed at the position located outwardly of the ribbon cassette. This leads to a necessity for separate spaces for the ribbon cassette and the platen roller, resulting in the printer being designed in larger dimensions.

Further, in the conventional apparatus fitting or removing of the cassette is achieved while it is supported from the surrounding part of the housing of the apparatus. This causes supporting and guilding members to be designed larger than the cassette and therefore the apparatus fails to be constructed in smaller dimensions.

In the case where the apparatus is operated with the use of dry batteries or a regular battery there is a necessity for space in which dry batterries or a regular battery is accommodated in addition to space for accommodating the cassette. This is another problem from the viewpoint of designing the apparatus in smaller dimensions.

SUMMARY OF THE INVENTION

Hence, the present invention has been made with the foregoing background in mind and its object resides in an improved image building apparatus which assures that both a ribbon cassette and a platen roller are suitably arranged without any necessity for separate spaces for them in the apparatus.

Another object of the invention is to provide an improved image building apparatus which is designed and constructed in smaller dimensions by substantially reducing space occupied by cassette supporting and guiding members by means of which fitting and removing of the ribbon cassette are achieved.

Another object of the invention is to provide an improved image building apparatus which does not require any space for accommodating dry batteries or a regular battery therein, resulting in the apparatus being designed in smaller dimensions.

To accomplish to the above objects, there is proposed according to one aspect of the invention an improved image building apparatus essentially comprising a recording head having a number of recording elements arranged in plural lines, the recording surface of the recording head being oriented upwardly, cassette means in the form of a ribbon cassette detachably fitted to the housing of the apparatus, the cassette means including ink donor medium, a pair of cores with the ink donor medium spanned therebetween and a platen roller disposed in the area as defined between the pair of cores, a part of the peripheral surface of the platen roller coming in pressure contact with the recording surface of the recording head when the cassette means is fitted to the housing of the apparatus and transportation of ink donor medium and printing medium which are interposed between the recording head and the platen roller being carried out by rotating the platen roller, all of the ink donor medium, the pair of cores and the platen roller being accommodated within a case, and driving means for rotating the cores and the platen roller to transport ink donor medium and printing medium while the cassette means is fitted to the housing of the apparatus.

Since the platen roller is disposed in the ribbon cassette of which case includes a pair of cores while ink donor medium is spanned therebetween and moreover the platen roller is located at the position between the pair of cores, the platen roller can be displaced together with the ribbon cassette when the latter is fitted to or removed from the housing of the apparatus.

Further, there is proposed according to another aspect of the invention an improved image building apparatus essentially comprising a recording head having a number of recording elements arranged in plural lines, the recording surface of the recording head being oriented upwardly, a platen roller adapted to come in contact with the recording surface of the recording elements constituting the recording head with a part of the peripheral surface thereof in order to transport ink donor medium and printing medium which are interposed therebetween, cassette means detachably fitted to the housing of the apparatus and having a pair of cores accommodated in a case in which ink donor medium and printing medium are transported with the aid of the pair of cores, the cores being formed with openings extending in the axial direction thereof, a pair of cassette supporting members disposed in the housing of the apparatus to detachably support the cassette means in the axial direction of the cores, the cassette supporting members being inserted through the openings of the cores, and driving means for rotating the cores and the platen roller to transport ink donor medium and printing medium while the cassette means is fitted to the housing of the apparatus.

Since the pair of cores are formed with openings extending in the axial direction thereof in the cassette means and the pair of cassette supporting members are disposed in the housing of the apparatus so as to allow them to be removably inserted through the openings of the cores, fitting and removing of the cassette means can be achieved with the aid of the cassette supporting members while it is supported and guided properly.

Further, there is proposed according to another aspect of the invention an improved image building apparatus essentially comprising a recording head having a number of recording elements arranged in plural lines, the recording surface of the recording head being oriented upwardly, cassette means in the form of ribbon cassette detachably fitted to the housing of the apparatus, the cassette means including ink donor medium, a pair of cores with the ink donor medium spanned therebetween, each of the cores having an opening extending in the axial direction thereof, and a platen roller disposed in the area as defined between the pair of cores, a part of the peripheral surface of the platen roller coming in pressure contact with the recording surface of the recording head when the cassette means is fitted to the housing of the apparatus and transportation of ink donor medium and printing medium which are interposed between the recording head and the platen roller being carried out by rotating the platen roller, all of the ink donor medium, the pair of cores and the platen roller being accommodated within a case, a pair of cassette supporting members disposed in the housing of the apparatus to detachably support the cassette means in the axial direction, the cassette supporting members being inserted into the openings of the cores, and driving means for rotating the cores and the platen roller to transport ink donor medium and printing medium while the cassette means is fitted to the housing of the apparatus.

In the apparatus of the invention each of the cassette supporting members has a hollow space in which a plurality of dry batteries or a single regular battery is accommodated.

Since the platen roller is integrally arranged at the position located between the pair of cores in the case of the ribbon cassette, there is no necessity for specific space to be occupied by the platen roller. As a result, the apparatus can be designed and constructed in smaller dimensions. Further, there is no necessity for allowing the platen roller to be displaced away from the cassette when the latter is to be replaced with another one, because the platen roller is disposed within the cassette.

Further, since the pair of cassette supporting members adapted to be inserted into the openings of the cores in the cassette serve to removably support the cassette in the axial direction of the cores when the cassette is fitted to or removed from the housing of the apparatus, the whole apparatus can be designed and constructed in smaller dimensions in the improved manner.

Further, since arrangement is made such that the hollow space in each of the cassette supporting members is utilized for accommodating a plurality of dry batteries of a single regular battery, there is no necessity for specific space in which a plurality of dry batteries or a single regular battery are accommodated, resulting in the apparatus being designed and constructed in smaller dimensions in the further improved manner.

Other objects, features and advantages of the present invention will become readily apparent from reading of the following discription which has been prepared in conjunction with the accompanying drawings.

BRIEF DESCRIPTION OF THE DRAWINGS

In the accompanying drawings:

FIG. 1 is a perspective view of the apparatus, particularly showing its geometrical configuration;

FIG. 2 is a schematic perspective view of the apparatus, particularly illustrating how the scanner section is arranged in the apparatus;

FIG. 3 is a schematic sectional side view of the apparatus, particularly illustrating how the scanner section is constructed;

FIG. 4 is a plan view of the apparatus, particularly illustrating how the direction of scanning as well as the direction of transportation of paper are determined;

FIG. 5 is a fragmental sectional plan view of the apparatus, particularly illustrating how the driving mechanism is constructed for the printer section;

FIG. 6 is a fragmental sectional side view of the apparatus, particularly illustrating how the printer section is constructed;

FIG. 7 is a schematic perspective view of the apparatus, particularly illustrating how the driving mechanism for the printer section is constructed;

FIG. 8 is a fragmental perspective view of the apparatus, particularly illustrating how the cassette is detachably fitted to the housing of the apparatus;

FIG. 9 is a fragmental sectional plan view of the apparatus, particularly illustrating how the cassette is fitted to the housing of the apparatus and how a plurality of dry batteries are accommodated in the guide members in the printer section;

FIG. 10 is a fragemental sectional plan view of the apparatus similar to FIG. 9, particularly illustrating how the cassette is fitted to the cassette accommodating space of the housing of the apparatus;

FIG. 11 is a sectional plan view of the ribbon cassette;

FIG. 12 is a sectional plan view of cores an ink ribbon spanned therebetween;

FIG. 13 is a plan view of the guide members;

FIG. 14 is a sectional plan view of the guide members, particularly illustrating how a plurality of dry batteries are accommodated in the guide members;

FIG. 15 is a block diagram showing a controlling system for the apparatus;

FIG. 16 is a sectional side view of the printer sectiin similar to FIG. 6, particularly illustrating how it is operated;

FIG. 17 is a fragmental sectional side view of the apparatus, illustrating how the platen roller comes in pressure contact with the thermal head in the printer section;

FIG. 18 is a fragmental sectional side view of the apparatus similar to FIG. 17, illustrating how the platen roller is displaced away from the thermal head to the inoperative position where the existing ribbon cassette can be replaced with another one;

FIG. 19 is a perspective view of a ribbon cassette which is disconnected from the housing of the apparatus;

FIG. 20 is a partially exploded perspective view of the ribbon cassette, particularly illustrting how the ink ribbon is pushed downwardly by means of the platen roller so as to allow the latter to come in pressure contact with the thermal head;

FIG. 21 is a perspective view of the ribbon cassette in the operative state where the case is removed therefrom for the purpose of clear illustration;

FIG. 22 is a perspective view of the ribbon cassette in the inoperative state where the platen roller is displaced away from the thermal head by turning movement; and FIG. 23 is a sectional plan view of the guide members similar to FIG. 14, illustrating how batteries are accommodated in the guide members in the printer section.

DESCRIPTION OF THE PREFERRED EMBODIMENTS

Now, the present invention will be described in a greater detail hereunder with reference to the accompanying drawings which schematically illustrate an image building apparatus in accordance with preferred embodiments of the invention.

Figure 1:
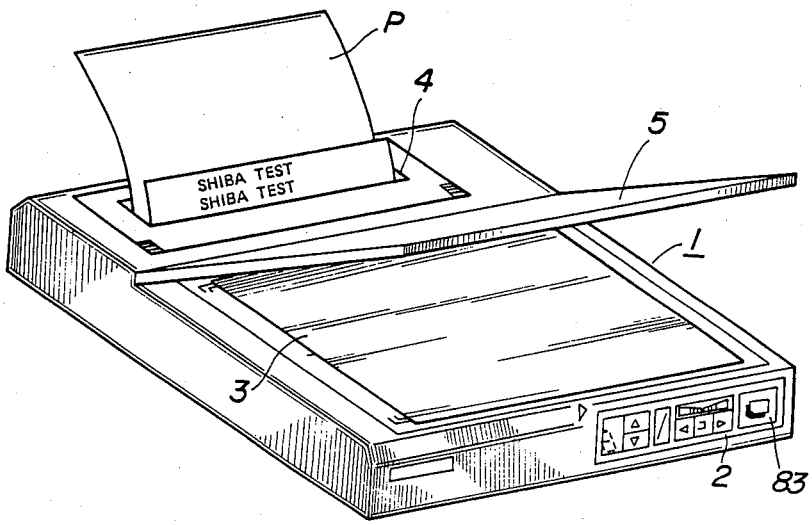
FIGS. 1 to 16 illustrate an image building apparatus in accordance with an embodiment of the invention.

FIG. 1 is a perspective view which shows the whole geometrical appearance of the apparatus. The housing 1 is provided with a controlling panel 2 on the front wall, an original holding board 3 on the upper surface and a paper discharging portion 4 at the position located behind the original holding board 3. The original holding board 3 is adapted to open and close when operations are performed by an operator.

Figure 2:
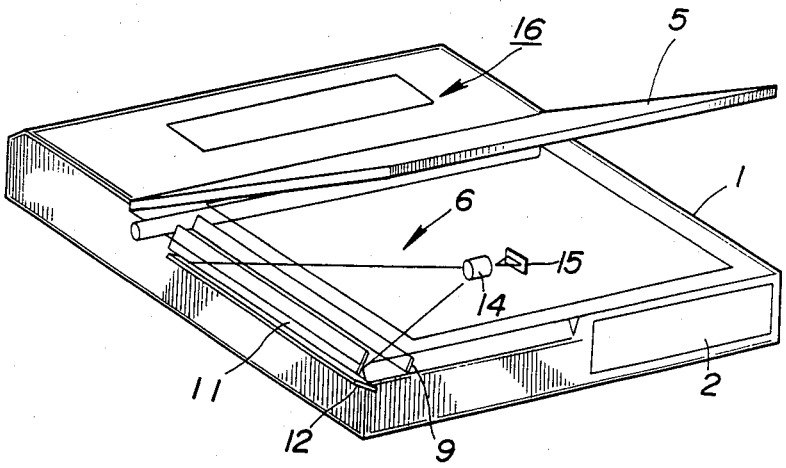
Figure 3:
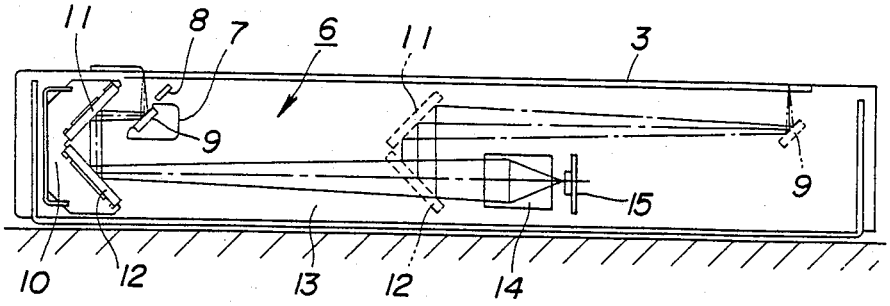
Figure 4:
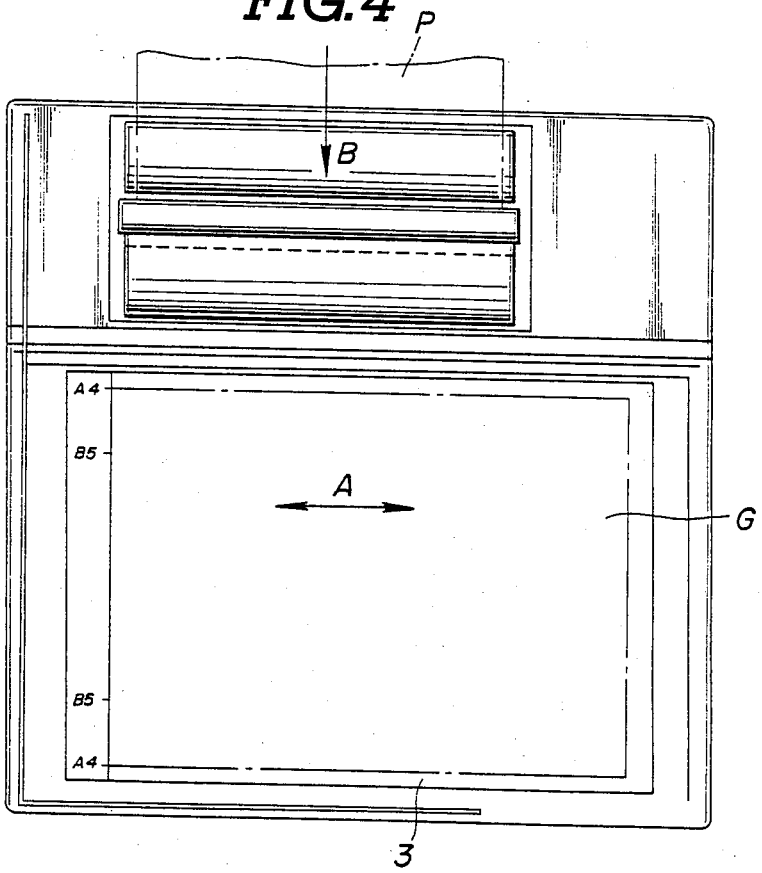

As shown in FIGS. 2 and 3, a scanner section 6 is arranged in the housing 1 in the area located below the original holding board 3. A lamp 8 and a first mirror 9 are recording head and the platen roller. A second mirror 11 and a third mirror 12 are mounted on a second carriage 10. Further, a lens 14 and a CCD image sensor (charge coupled device type image sensor) 15 are disposed within the passage of light beam which is reflected from the third mirror 12. The second carriage 10 is adapted to move at a half speed relative to that of the first carriage 7 in order to maintain the effective length of the passage of light beam constant. As represented by arrow marks A in Fig. 4, the first and second carriages 7 and 10 are displaced in parallel with the controlling board 2 to scan an original G.

A printer section 16 is arranged in the housing 1 in the area located behind the scanner section 6. Now, description will be made in more details with reference to FIGS. 5 to 14 as to how the printer section 16 is constructed.

As is shown in these drawings, cassette accommodating space 17 is disposed in the printer section 16 so that a ribbon cassette 18 is fitted thereinto and removed therefrom through an opening 19 having the rectangular configuration on one side wall printer section 16.

Figure 6:
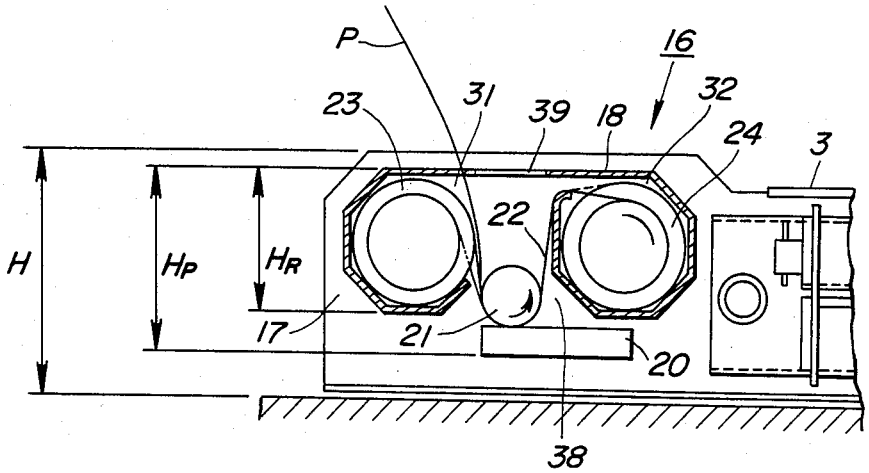

As shown in FIG. 6, the cassette accommodating space 17 includes a thermal head (recording head) 20 in the lower area which has a number of heating elements of that comprise a heating surface (serving as recording part) that is oriented upwardly. While the ribbon cassette 18 is fitted in accommodating space 17, the platen roller 21 is brought in pressure contact with the heating surface of the thermal head 20 with ink ribbon 22 serving as ink donor medium and paper P serving as printing medium interposed therebetween. As the platen roller 21 rotates, paper P is transported, whereas as cores 23 and 24 rotate, the ink ribbon 22 is transported. Thus, a required image is built on paper P. The direction of transportation of paper P is identified by an arrow mark B in FIG. 4.

As shown in FIGS. 7 to 11, the ribbon cassette 18 is constructed by a combination of ink ribbon 22, a pair of cores 23 and 24 on which both ends of the ink ribbon 22 are anchored, the platen roller 21 which is held rotatably in the cassette and a case 25 in which the above-mentioned components are accommodated. Specifically, the platen roller 21 is accommodated in the cassette 18 and thereby it is fitted into the apparatus or removed from the latter together with the cassette 18.

Figure 12:
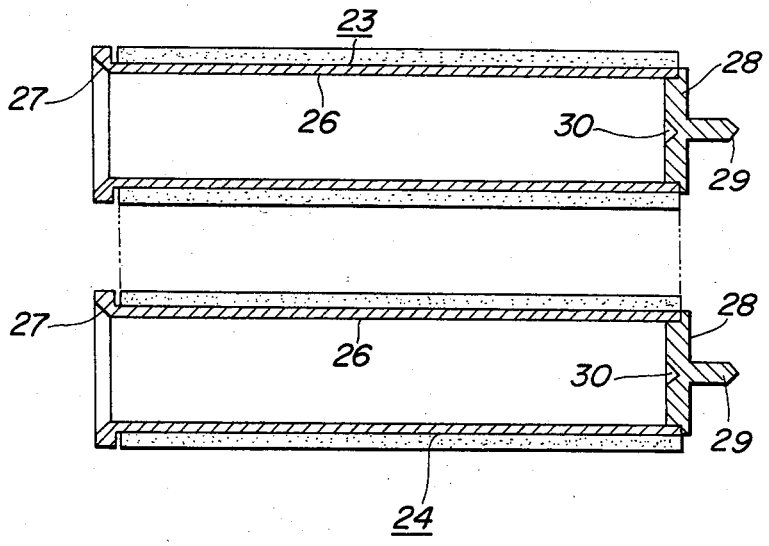

Referring to FIG. 12, each of the cores 23 and 24 is constructed by a combination of a cylindrical member 26 about which the ink ribbon 22 is wound, a tapered driving force receiving end part 27 at one end of the cylindrical member 26 and a flange 28 tightly fitted to the other end of the cylindrical member 26. The flange 28 has a projection 29 on the outside which serves to receive thrust force and further is formed with a conical centering recess 30 on the inside. As will be best seen in FIGS. 6 and 11, the case 25 includes a pair of core accommodating chambers 31 and 32 in which the cores 23 and 24 are accommodated. A pair of openings 33 on one side wall are located adjacent to the driving force receiving end parts 27 and a pair of holes 34 on the other side wall thereof serve as bearing means for the projections 29. Further, the case 25 includes a platen roller accommodating chamber 35 at the middle area thereof in which the platen roller 21 is rotatably accommodated and the side walls of case 25 formed with holes 36 so that both side walls serve as bearing means for rotating the platen roller 21. The platen roller 21 is equipped with a gear 37 at one end which is located outwardly of the side wall of the cassette whereby rotational force is transmitted to the platen roller 21 via the gear 37.

As in apparent from FIG. 6, the case 25 of the ribbon cassette 16 is designed in an inverted U-shaped configuration while a hollow space 38 is defined in the area between both of the bottoms of the core accommodating chambers 31 and 32, the lower side of the hollow space 38 being opened downwardly to the outside. A window 39 is formed at the position located above the hollow chamber 38 so that paper P may be introduced into the interior of the ribbon cassette 16 and then discharged therefrom through the window 39.

Figure 13:
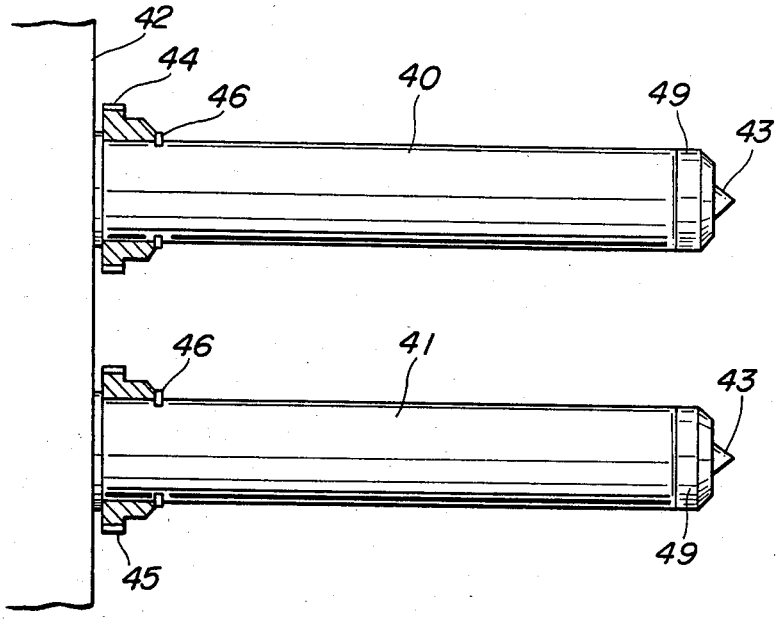
Figure 14:
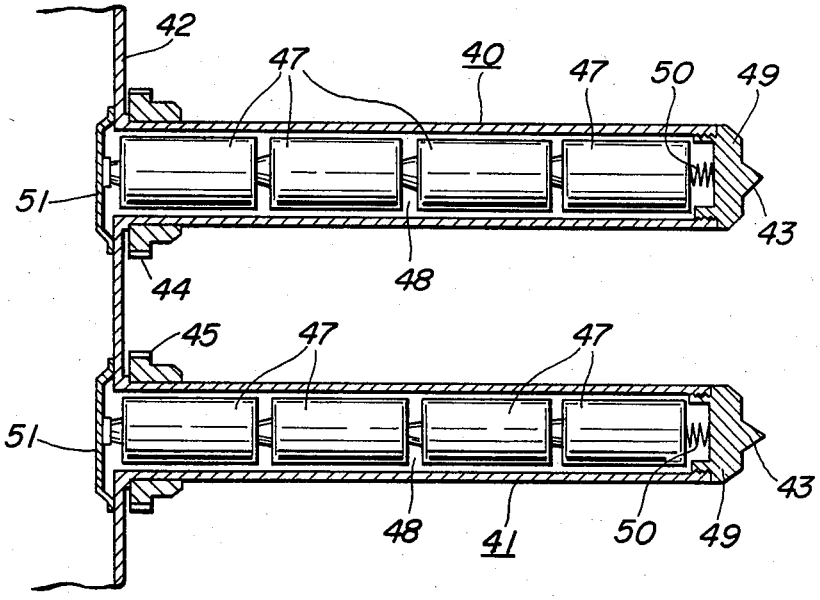

As shown in FIGS. 13 and 14, a pair of cylindrical guide members 40 and 41 (holding member) for guiding slidable movement of the cores 23 and 24 in the axial direction are projected from a supporting member 42 in the housing 1 in a cantilever fashion whereby the ribbon cassette 18 is held by means of the guide members 40 and 41 in such a manner that cassette 18 is fitted onto or removed from the latter in the axial direction of the cores 23 and 24. It should be noted that the guide members 40 and 41 are located in the cassette accommodating space 17 and their fitting is achieved by inserting them through the openings 33 on the one side wall of the cassette case 25 until their bottom parts abut against the driving force receiving parts 27 of the cores 23 and 24. Further, the guide members 40 and 41 have conical centering projections 43 at the foremost end which are adapted to come in engagement to the conical centering recesses 30 of the cores 23 and 24. Gears 44 and 45 for transmitting rotational force to the cores 23 and 24 are rotatably mounted on the bottom end parts of the guide members 40 and 41. Obviously, transmission of rotational force to the cores 23 and 24 is carried out while the conical ends of the gears 44 and 45 are firmly engaged to the driving force receiving end parts 27 of the cores 23 and 24. In FIG. 13, a stopper 46 is shown which serves to inhibit movement of the gears 44 and 45 in the axial direction.

Figure 9:
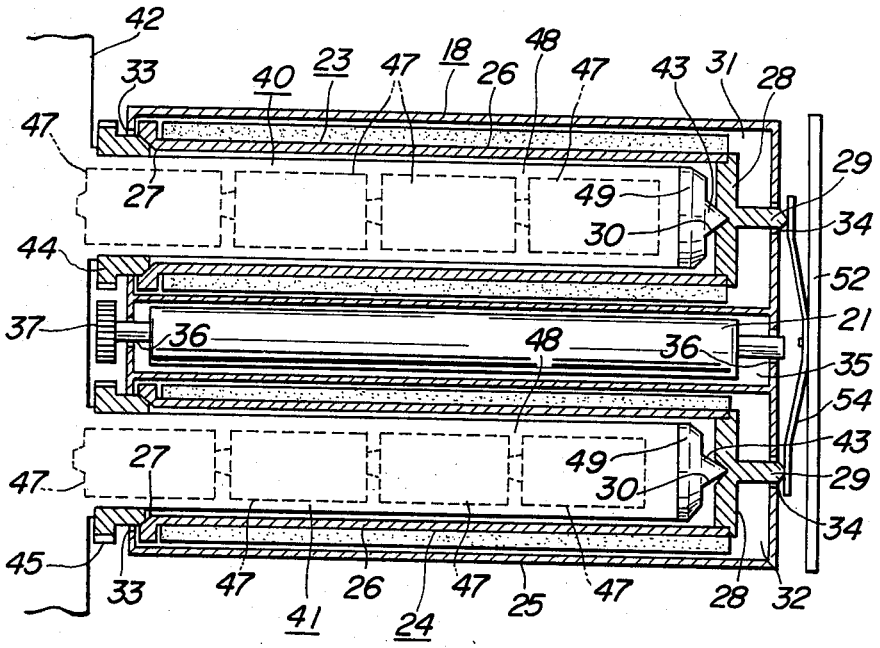

As shown in FIGS. 9 and 14, the interior of the guide members 40 and 41 serves as accommodating space 48 in which a plurality of dry batteries 47 serving as an electrical power source are accommodated for the purpose of operating the apparatus. As is apparent from the drawings, the fore end part of the guide members 40 and 41 is designed in the form of a screw type cap 49 and therefore dry batteries 47 can be inserted into the accommodating space 48 of each of the guide members 40 and 41 one after another while the cap 49 is removed from the latter. A coil spring 50 is disposed in the space located inwardly of the cap 49. Thus, when the cap 49 is threadably engaged to the guide members 40 and 41, a series of dry batteries 47 are forcibly displaced toward a terminal 51 under the effect of resilient force of the coil spring 50. The spring 50 is made of electric conductive material and a lead wire which is not shown in the drawing is extended toward the bottom part of the guide members 40 and 41. Alternatively, the guide members 40 and 41 themselves may be made of electric conductive material. In this case, no lead wire is required. In the illustrated embodiment, the dry batteries 47 are arranged in the sereis relation but they may be arranged in the parallel relation.

Figure 10:
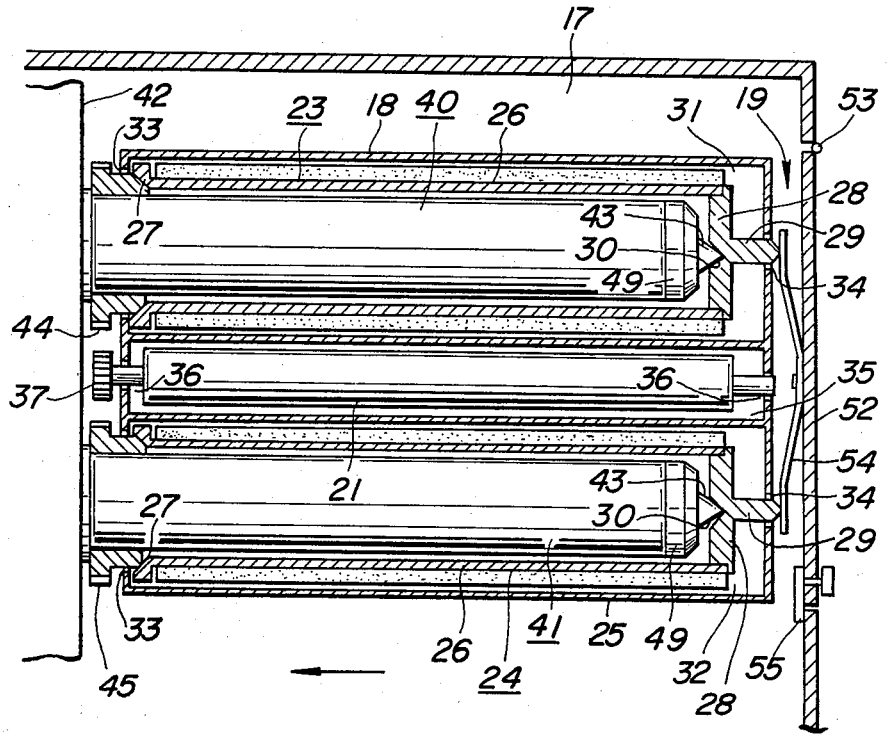
Figure 11:
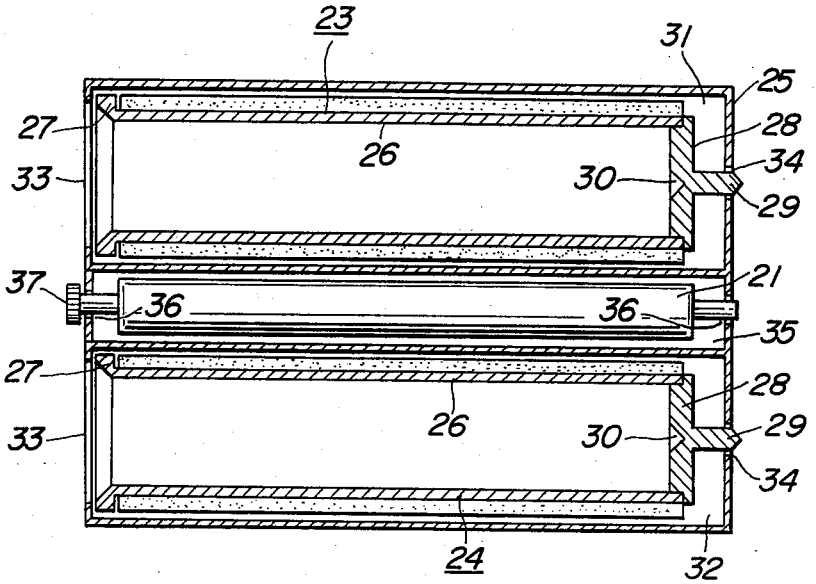

As shown in FIG. 10, a cover 52 is turnably fitted to the rectangular opening 19 on the one side wall of the housing 1 by means of a hinge joint 53, and a leaf spring 54 is disposed in the area located inwardly of the cover 52. While the cover 52 is fitted to the housing in the closed state, both end parts of the leaf spring 54 are brought in tight contact with the foremost ends of the projections 29 from the cores 23 and 24 which are projected outwardly of the case 25 of the ribbon cassette 18. This causes the driving force receiving end parts 33 of the core 23 and 24 to come in firm contact with the conical ends of the gears 44 and 45 whereby rotational force is transmitted from the motor to the cores 23 and 24. In FIG. 10, reference numeral 55 designates a locking member which serves to keep the cover 52 in the closed state.

Figure 5:
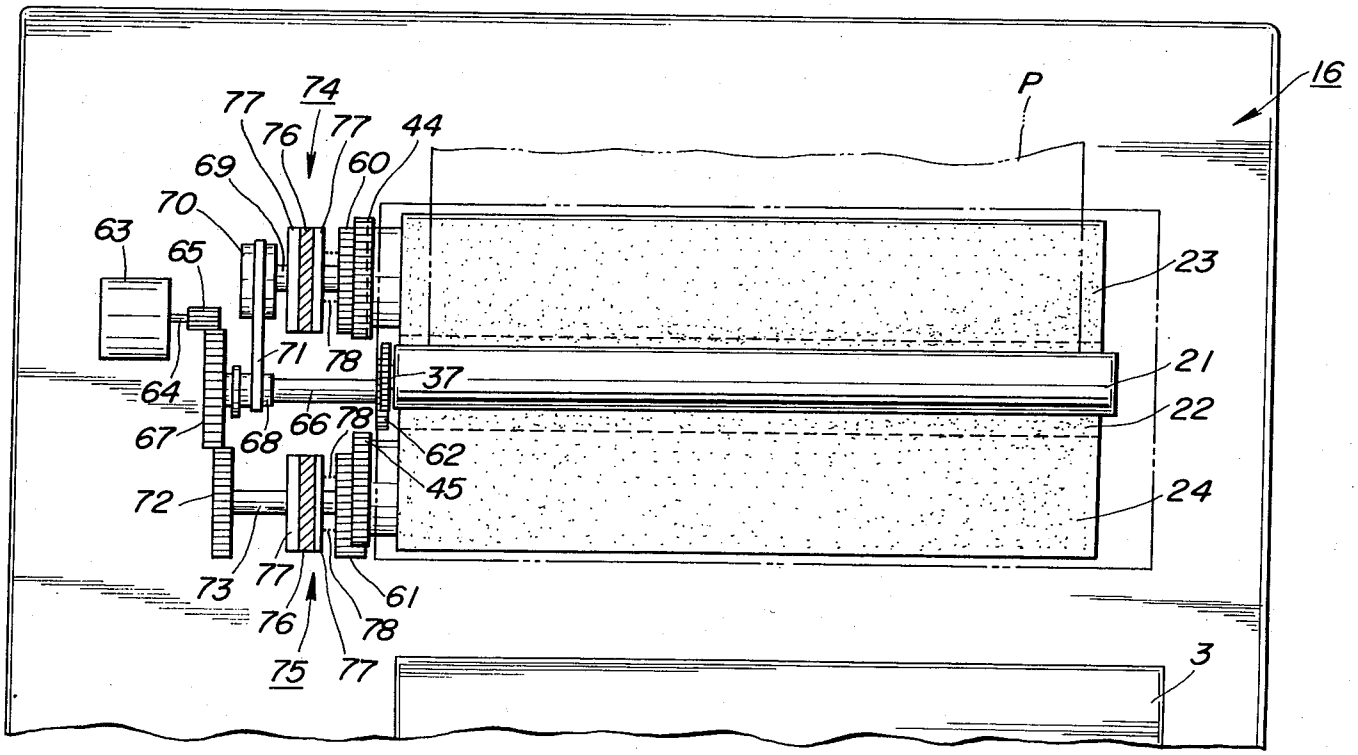
Figure 7:
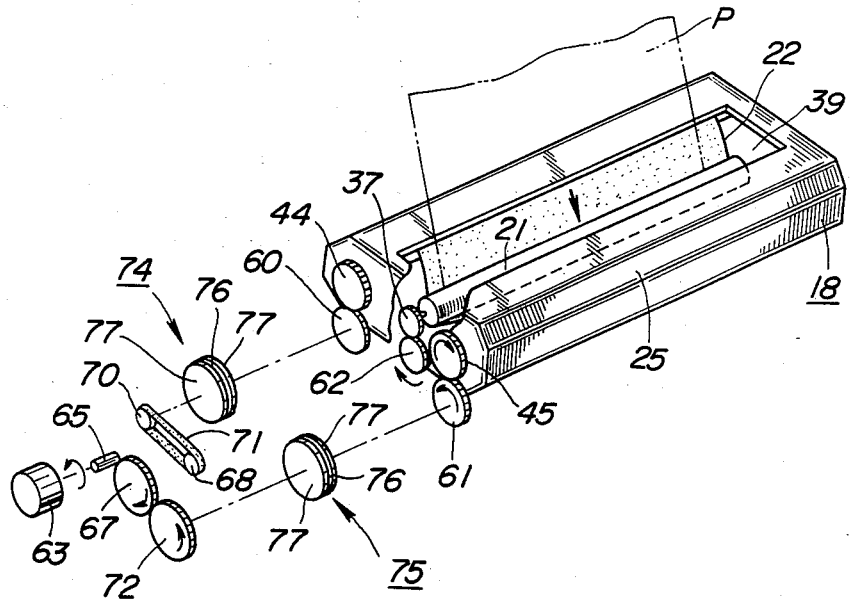
Figure 8:
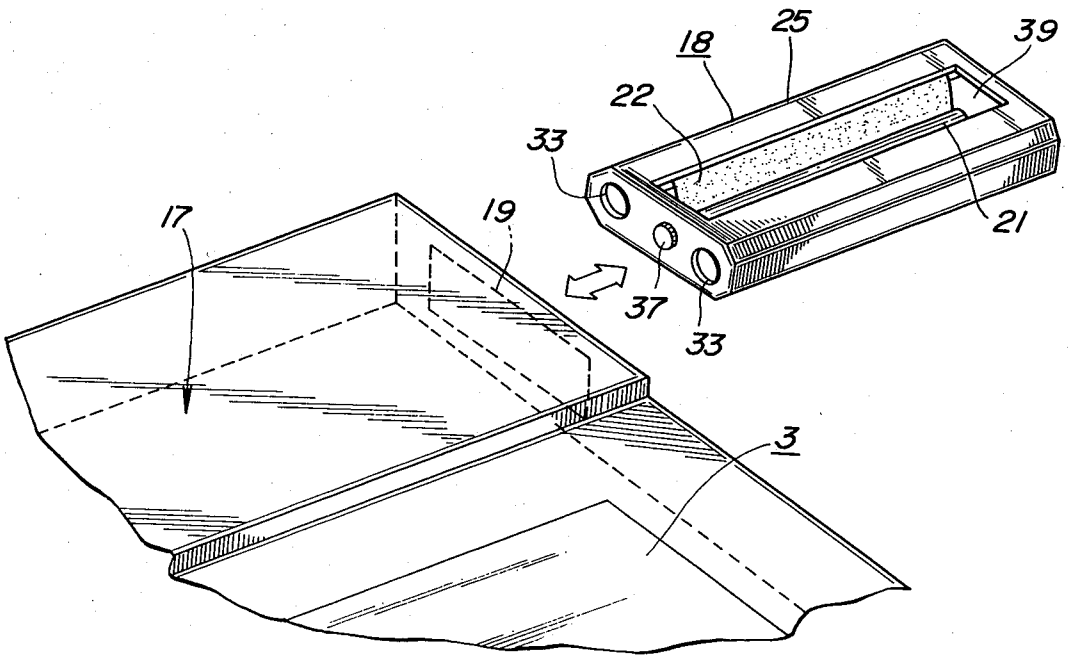

Referring FIGS. 5 to 7, description will be made as to a mechanism for rotationally driving the cores 23 and 24 and the platen roller 21 in the cassette 18 which is fitted to the housing of the apparatus.

While the ribbon cassette 18 is fitted to the housing of the apparatus, the gears 44 and 45 on the guide members 40 and 41 and the gear 37 on the platen roller 21 are brought in meshing engagement with gears 60, 61 and 62 on the housing side. Specifically, the rotational shaft 64 of the motor 63 is equipped with a gear 65 which in turn meshes with a gear 67 fixedly mounted on the first transmission shaft 66. The first transmission shaft 66 is equipped with the gear 62 which meshes with the gear 37 on the platen roller 21 whereby rotational force is transmitted to the platen roller 21. A pulley 68 is fixedly mounted on the first transmission shaft 66 and a pulley 70 is fixedly mounted on the second transmission shaft 69 so that an endless belt 71 is spanned between both the pulleys 68 and 70. The gear 67 on the first transmission shaft 66 meshes with a gear 72 which is fixedly mounted on the third transmission shaft 73. Further, the second and third transmission shafts 69 and 73 are provided with frictional clutches 74 and 75. Each of the frictional clutches 74 and 75 comprises a frictional plate 76, a pair of circular plates 77 with a frictional plate 76 clamped therebetween and a coil spring 78 adapted to displace the circular plate 77 on the ribbon cassette side toward the frictional plate 76 under the effect of resilient force of the spring 78 whereby rotational force is transmitted from the motor 63 with a predetermined intensity of frictional torque. Further, the second and third transmission shafts 69 and 73 are equipped with the gears 60 and 61 which in turn mesh with the gears 44 and 45 on the cores 23 and 24 whereby rotational force is transmitted to the cores 23 and 24.

In the case of the embodiment as illustrated in FIG. 6, the core 23 on the unwinding side is subjected to force which is effective in the opposite direction (in the clockwise direction) to the direction of rotation (in the anticlockwise direction) of the core 24 on the winding side in order to assure that the ink ribbon 22 is spanned between both the cores 23 and 24 under the effect of a predetermined intensity of tension. In practice, however, rotation of the core 23 on the unwinding side is caused to follow rotation of the core 24 on the winding side due to difference in frictional force of the frictional clutches 74 and 75 or the like factor. As a result, the core 23 on the unwinding side rotates in the same direction (in the counterclockwise direction) while slippage takes place with the frictional clutch 75.

Figure 15:
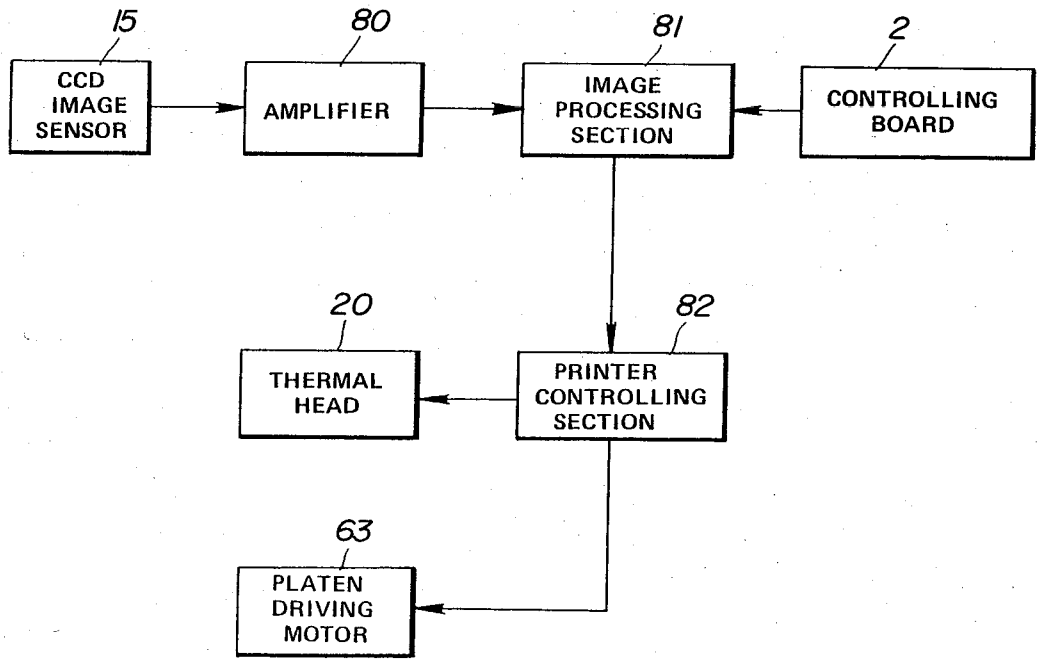
Figure 16:
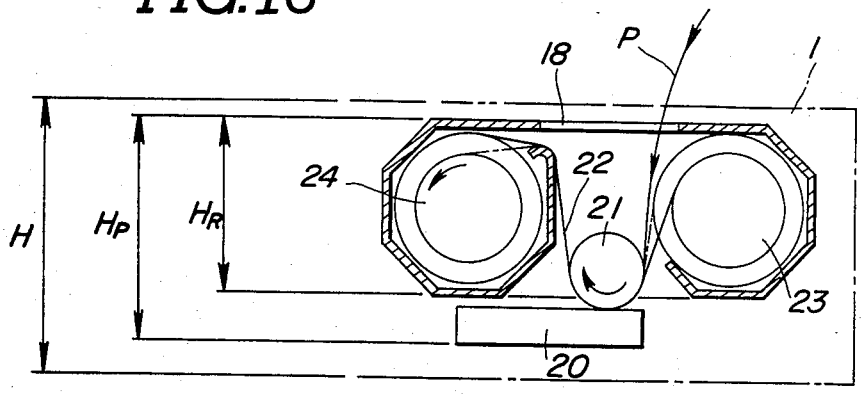

On the other hand, as shown in FIG. 15, CCD sensor 15 in the scanner section 6 is electrically connected to an image processing section 81 via an amplifier 80 and the image processing section 81 is electrically connected to the thermal head 20 in the printer section 16 and the platen roller driving motor 63 via a printer controlling section 82 whereby the thermal head 20 and the driving motor 63 become activated in response to image information transmitted in that way.

Next, operation of the image building apparatus of the invention will be described below.

When printing is to be effected, an original G is first placed on the original holding board 3 and the ribbon cassette 18 is then fitted into the cassette accommodating space 17. Thereafter, an operator depresses a printing button 83. In response to the depressing operation performed in that way the first and second carriages 7 and 10 in the scanner section 6 are caused to move whereby scanning is effected by emitting light beam toward the original G. Reflected light beam is received by means of the CCD sensor 15 via the first to third mirrors 9, 11 and 12 and the lens 14 to read image on the original G. Thus obtained image information is transmitted to the image processing section 81 to actuate the printer controlling section 82. In accordance with command from the printer controlling section 82, the thermal head 20 and the driving motor 63 are activated and the thermal head 20 is then heated up in dependence on inputted image information whereby ink on the ink ribbon 22 is transferred onto paper P to build a required image thereon while paper P is transported by rotation of the platen roller 20.

According to the embodiment of the invention as described above, the pair of cores 23 and 24 and the platen roller 21 located therebetween are integrally accommodated in the case 25 of the ink ribbon cassette 18. This causes the space in the case 25 to be utilized as space required for mounting the platen roller 21, resulting in the apparatus being designed in smaller dimensions.

When the existing cassette 18 is replaced with another one, there does not take place such a malfunction as interference of the platen roller 21 with other components. Thus, there is no necessity for any special mechanism for displacing the platen roller 21 away from the cassette 18 and any means for actuating the mechanism as mentioned above.

Further, according to the embodiment of the invention as described above the housing of the apparatus is provided with the guide members 40 and 41 adapted to slidably receive the cores 23 and 24 of the ribbon cassette 18 while both the cores 23 and 24 are rotatably accommodated in the ribbon cassette 18. Thus, there is no necessity for any special guiding means for supporting the ribbon cassette while surrounding the latter from the outside, resulting in the space as defined inside both the cores 23 and 24 being utilized effectively. This leads to an advantageous feature that the apparatus is designed in smaller dimensions.

Since arrangement is made such that the interior of the guide members 40 and 41 is utilized for the purpose of accommodating a plurality of dry batteries 47 therein, an unused part of the accommodating space in the ribbon cassette 18 can be effectively utilized as accommodating space for the batteries 47. Accordingly, any particular accommodating space required for the batteries 47 is not required by utilizing the fitting space in the housing for the ribbon cassette 18. As a result, the apparatus can be designed in smaller dimensions in the further improved manner.

Owing to the arrangement made in such a manner that the platen roller 21 is disposed in the space as defined between both the cores 23 and 24 as shown in FIG. 6, the height H of the housing 1 is determined approximately equal to a dimension Hp which comprises the height Hr of the ribbon cassette 18 plus the height of the thermal head 20. This means that the height H of the housing can be reduced substantially and thereby the apparatus can be designed in a thin structure.

Next, description will be made as to an image building apparatus in accordance with another embodiment of the invention with reference to FIGS. 17 to 22.

Figure 17:
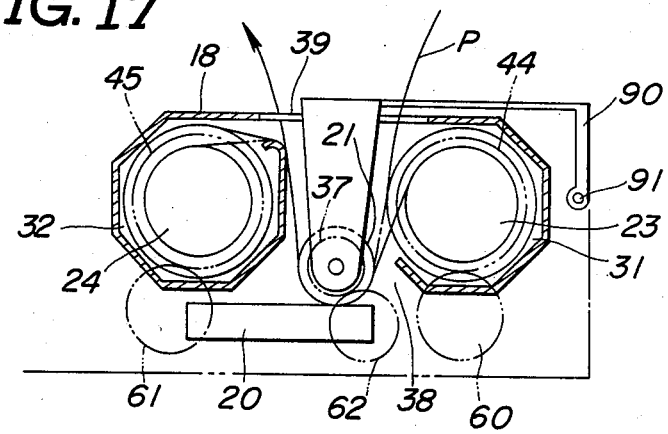
FIG. 17 to 23 illustrate an image building apparatus in accordance with another embodiment of the invention.
Figure 18:
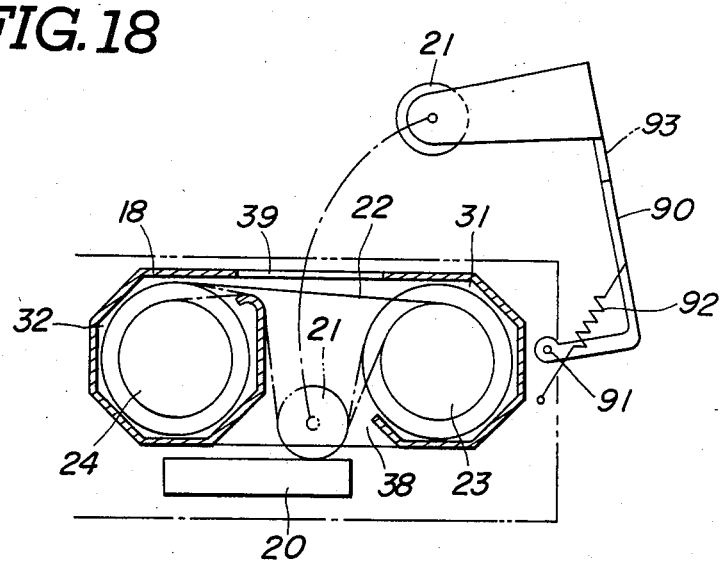
Figure 19:
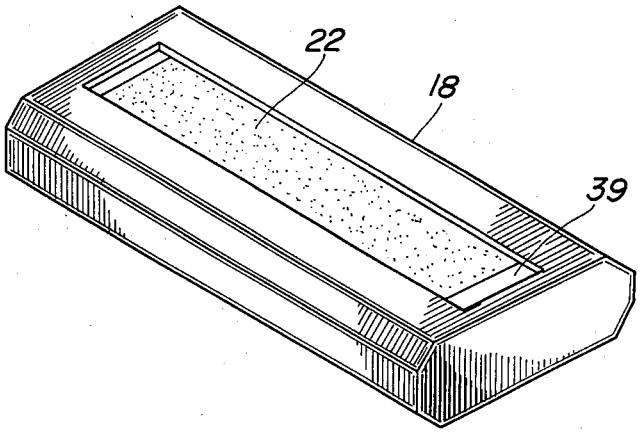
Figure 20:
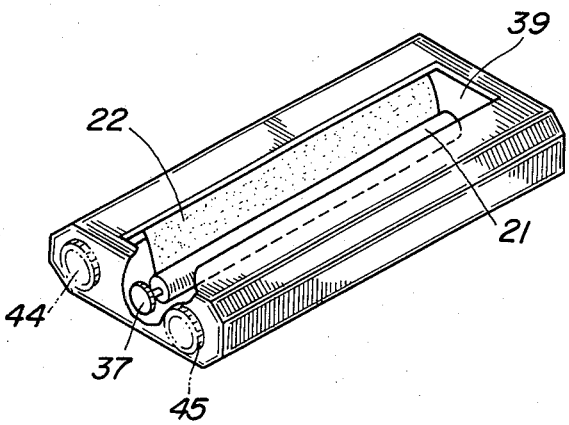
Figure 21:
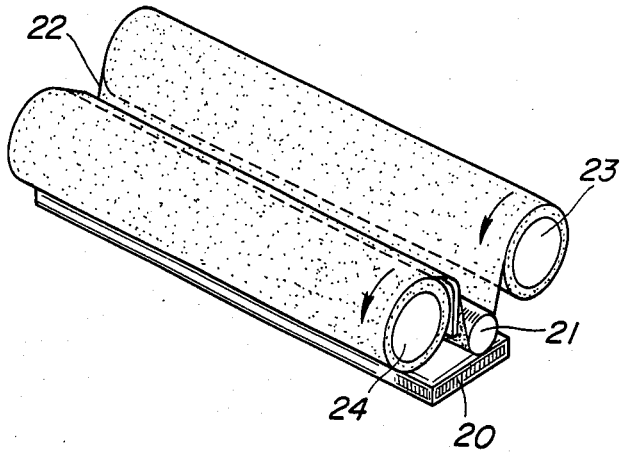
Figure 22:
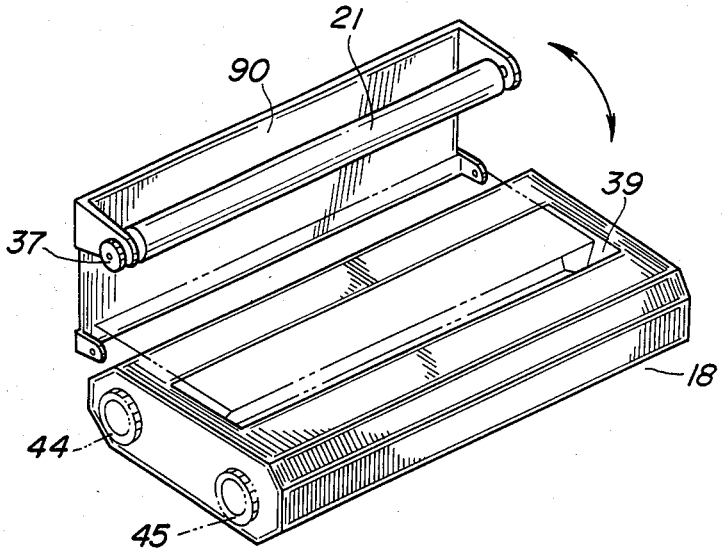

In the embodiment shown in FIGS. 17–22, an arm 90 having the substantially inverted U-shaped cross-sectional configuration is displaceably held on the one side of the housing 1 so as to turn about a pivotal shaft 91, as shown in FIGS. 17 and 18. The width of the arm 90 is so determined that it extends across the one core accommodating chamber 31 of the ribbon cassette 18. A platen roller 21 is rotatably carried at the other end of the arm 90 so that it comes in contact with and moves away from the heating surface of the thermal head 20 through the window 39 and the hollow space 38 as the arm 90 turn in the counterclockwise direction as well as in the clockwise direction as seen in the drawings. Further, the arm 90 is adapted to turn under the effect of a coil spring 92 so that the platen roller 21 assumes one of two operative positions depending on the positional relation between the spring 92 and the pivotal shaft 91, one of the operative positions being such that platen roller 21 comes in pressure contact with the heating surface of the thermal head 20 with the ink ribbon 22 interposed therebetween and the other operative position being such that platen roller 21 is displaced away from the thermal head until the ribbon cassette 18 becomes able to be replaced with another one. Thus, when the platen palten roller 21 is required to come in pressure contact with the thermal head 20, the ink ribbon 22 is depressed bymeans of the platen roller 21 from the window side toward the thermal head 20 under the effect of resilient force of the spring 92. Specifically, while the ribbon cassette 18 is removed from the housing of the apparatus, the ink ribbon 22 is linearly stretched between both cores 23 and 24, as shown in FIG. 19. On the other hand, while the ribbon cassette 18 is fitted to the housing, the ink ribbon 22 is pushed downwardly toward the thermal head 20 in the substantially U-shaped configuration as the platen roller 21 is displaced downwardly to come in pressure contact with the thermal head 20. It should be noted that paper P passes through an insert opening 93 on the arm 90 and it is then inserted into the space between the platen 21 and the ink ribbon 22 whereby it is transported while it is held therebetween. As shown in FIG. 22, the platen roller 21 is equipped with a gear 37 by way of which rotational force is transmitted from the motor to the platen roller 21. Further, the cores 23 and 24 are equipped with gears 44 and 45 by way of which rotation force is transmitted from the motor to the cores 23 and 24. Also in this embodiment, the gear 37 and the gears 44 and 45 on the ribbon cassette 18 are brought in meshing engagement with gears 62, 60 and 61 on the housing 1 of the apparatus in the same manner as in the foregoing embodiment while the ribbon cassette 18 is fitted to the housing of the apparatus.

This embodiment is different from the foregoing embodiment in respect of the fact that the platen roller 21 can be removed from the ribbon cassette 18 as illustrated in FIGS. 9 to 14 and it is turnably supported from the housing side.

Figure 23:
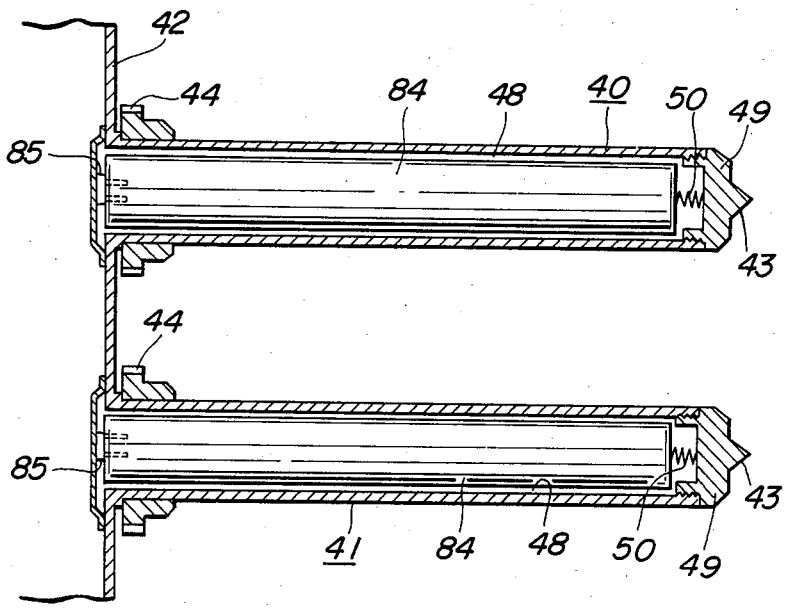

It should of course be understood that the present invention should not be limited only to these embodiments but various changes or modifications may be made in any suitable manner without departure from the spirit and scope of the invention. For instance, in the first-mentioned embodiment, the guide members 40 and 41 include accommodating space 48 in which a plurality of dry batteries 47 are accommodated one after another in the aligned relation. Alternatively, a single battery 84 may be accommodated in the accommodating the space 48 as shown in FIG. 23. In this case, a pair of electrodes 85 are located only on the bottom side of the guide members 40 and 41. Further, the cap 49 adapted to be removed so as to allow dry batteries 47 or single battery 84 to be accommodated may be located on the bottom side of the guide members 40 and 41.

Further, the platen roller made integral with the ribbon cassette in the first-mentioned embodiment may be so modified that it is fixedly secured to a case by means of screws or a position determining mechanism so that it can be removed therefrom by an operator as required.

The mechanism for supporting or rotating the cores and the platen roller should not be limited only to the illustrated one. Alternatively, any other mechanism may be employed, provided that it functions properly.

The present invention has been described above with respect to the embodiments where it is applied to a thermal transfer type heat sensitive printer. However, the present invention should not be limited only to this type. It may be applied to an image building apparatus for which other recording systems are employed, provided that the apparatus is operated in such a manner that ink donor medium and printing medium are interposed between the platen roller and the recording head and coloring agent on ink donor medium is transferred onto printing medium.

What is claimed is:

1. A cassette for fitting into a housing of an image building apparatus having a recording head that builds an image on a printing medium, the cassette comprising:

an ink donor medium for transferring ink on said ink donor medium onto the printing medium;

a pair of cores with said ink donor medium spanned therebetween; and a platen roller disposed between the pair of cores, a part of the peripheral surface of the platen roller coming in pressure contact with a recording surface of the recording head via said ink donor medium and said printing medium when the cassette means is fitted into the housing of the image building apparatus.

2. An image building apparatus for building an image on a printing medium, comprising:

a housing;

a recording head disposed in said housing, said recording head having a number of recording elements arranged in line on a recording surface of said recording head;

cassette means detachably fitted to said housing, said cassette means including an ink donor medium for transferring ink on said ink donor medium onto the printing medium, a pair of cores with said ink donor medium spanned therebetween and a platen roller disposed in an area between the pair of cores, a part of the peripheral surface of said platen roller coming in pressure contact with the recording surface of the recording head via said ink donor medium and said printing medium when the cassette means is fitted to the housing of the apparatus, said ink donor medium, said pair of cores and said platen roller being accommodated within a case of said cassette means; and driving means disposed in said housing for rotating the cores and the platen roller to transport the ink donor medium and the printing medium when the printing medium is superposed on the ink donor medium while the cassette means is fitted to the housing of the apparatus.

3. An image building apparatus as defined in claim 1, wherein said platen roller is detachably supported in the case of the cassette means.

4. An image building apparatus as defined in claim 1, wherein said driving means comprises a core driving mechanism for imparting rotational force to each of the pair of cores in opposite directions to each other, the ink donor medium spanned between the cores being stretched at a predetermined intensity of tension caused by said rotational force.

5. An image building apparatus as defined in claim 1, wherein the recording surface of said recording head is oriented upwardly.

6. An image building apparatus for building an image on a printing medium, comprising:

a housing;

a recording head having a number of recording elements arranged in line on a recording surface of the recording head;

cassette means detachably fitted to said housing, said cassette means including a case, an ink donor medium for transferring ink on said ink donor medium onto the printing medium, a pair of rotatable cores with said ink donor medium spanned therebetween, each of said cores being hollow, and a platen roller disposed in an area between the pair of cores, a part of the peripheral surface of said platen roller coming in pressure contact with the recording surface of the recording head via said ink donor medium and said printing medium when the cassette means fitted to the housing of the apparatus, said ink donor medium, said pair of cores and said platen roller being accommodated within said case;

a pair of cassette supporting members disposed in the housing of the apparatus with one end of each of said supporting members being fixed to said housing and the other end of each of said supporting members being free, said pair of supporting members detachably supporting said cassette means in the axial direction when said cassette supporting members are inserted into said hollow portions of the cores; and driving means for rotating the cores and the platen roller to transport the ink donor medium and the printing medium when the printing medium is superposed on the ink donor medium while the cassette means is fitted to the housing of the apparatus.

7. An image building apparatus as defined in claim 6, wherein said platen roller is supported in such a manner that it is fitted into and removed from the case of the cassette means.

8. An image building apparatus as defined in claim 6, wherein each hollow portion of said pair of cassette supporting members forms a chamber in which a portable electric power source serving as electric power source for the apparatus is accommodated.

9. An image building apparatus for building an image on a printing medium, comprising:

a housing;

a recording head having a number of recording elements arranged in line on a recording surface of the recording head;

cassette means detachably fitted to said housing, said cassette means including a case, an ink donor medium for transferring ink on said ink donor medium onto the printing medium, a pair of rotatable cores with said ink donor medium spanned therebetween, each of said cores being hollow, and a platen roller disposed in an area between the pair of cores, each of said cores being closed at an end wall at one end and open at the other end, said case provided with a pair of openings at positions aligned with said open ends of the cores, a part of the peripheral surface of said platen roller coming in pressure contact with the recording surface of the recording head via said ink donor medium and said printing medium when the cassette means is fitted to the housing of the apparatus, said ink donor medium, said pair of cores and said platen roller being accommodated within said case;

a pair of cassette supporting members diposed in the housing of the apparatus with one end of each of said supporting members being fixed to said housing and the other end of each of said supporting members being free, said pair of supporting members detachably supporting said cassette means in the axial direction when said cassette supporting members are inserted into said hollow portions of the cores, said pair of cassette supporting members each provided with a protrusion at the free end of each supporting member, an inner surface of each of the end walls of said pair of cores being provided with a recess for engaging the corresponding protrusions of said cassette supporting members; and driving means for rotating the cores and the platen roller to transport the ink donor medium and the printing medium when the printing medium is superposed on the ink donor medium while the cassette means is fitted to the housing of the apparatus.

10. An image building apparatus as defined in claim 9, wherein said pair of cores are each provided with a projection on an outer surface of the end wall at the center thereof, and said case of said cassette means is provided with a pair of holes receiving said projections to rotatably support said pair of cores, said projections on the pair of cores projecting outwardly of the pair of holes in the case.

11. An image building apparatus as defined in claim 10, wherein said housing of the apparatus is formed with an opening on one side wall through which the cassette means is fitted into and removed from the housing and is formed with a cover with a leaf spring fixedly secured to the inside wall thereof, said cover fitted to said opening on the housing so that the projections of the pair of cores projected outwardly of the pair of holes on the case comes in contact with said leaf spring while the cover is kept in the closed state and the pair of cores are thereby rotatably supported on the supporting members.

12. An image building apparatus as defined in claim 9, wherein said pair of cores are each formed with a driving force receiving member at the open end of each said core, and said pair of cassette supporting members are each provided with a driving force transmitting member for engaging with said driving force receiving members and transmitting driving force produced by said driving means to said pair of engaged cores.

* * * * *